US008646197B2

(12) United States Patent
Clark et al.

(10) Patent No.: US 8,646,197 B2
(45) Date of Patent: Feb. 11, 2014

(54) SYSTEMS AND METHODS FOR HANGING OVERHEAD SIGNS FROM A CEILING

(75) Inventors: Jeremy A. Clark, Minneapolis, MN (US); Amy M. Bacskai, St. Paul, MN (US); Daniel Golke, Chicago, IL (US)

(73) Assignee: Target Brands, Inc., Minneapolis, MN (US)

( * ) Notice: Subject to any disclaimer, the term of this patent is extended or adjusted under 35 U.S.C. 154(b) by 92 days.

(21) Appl. No.: 13/315,922

(22) Filed: Dec. 9, 2011

(65) Prior Publication Data

US 2013/0145662 A1 Jun. 13, 2013

(51) Int. Cl.

| | |
|---|---|
| ***G09F 7/22*** | (2006.01) |
| ***G09F 7/00*** | (2006.01) |
| ***A47G 1/16*** | (2006.01) |
| ***A47G 1/24*** | (2006.01) |

(52) U.S. Cl.

USPC ..... 40/617; 40/601; 40/602; 248/489; 248/490; 248/496; 248/498; 248/317

(58) Field of Classification Search

USPC ..... 40/617, 601, 602; 248/489, 490, 496, 248/498, 317

See application file for complete search history.

(56) References Cited

U.S. PATENT DOCUMENTS

| | | | | |
|---|---|---|---|---|
| 170,607 | A | | 11/1875 | Underhill |
| 1,261,036 | A | | 4/1918 | Kerns |
| 2,542,172 | A | | 2/1951 | Wold |
| 4,017,991 | A | * | 4/1977 | Berger ..... 40/440 |
| 4,191,352 | A | | 3/1980 | Schuplin |
| 4,223,488 | A | | 9/1980 | Schoenung |
| 4,519,564 | A | | 5/1985 | Nadherny |
| D283,674 | S | | 5/1986 | Paradis et al. |
| 5,104,169 | A | * | 4/1992 | Kopnski ..... 296/1.02 |
| 5,364,053 | A | | 11/1994 | Rodgers |
| 5,381,991 | A | | 1/1995 | Stocker |
| 5,480,116 | A | | 1/1996 | Callas |
| 5,499,789 | A | * | 3/1996 | Rose ..... 248/489 |
| 5,522,165 | A | | 6/1996 | Molla |
| D374,168 | S | | 10/1996 | Protz, Jr. |

(Continued)

OTHER PUBLICATIONS

"Double Hooks," www.hangups.com/DoubleHooks.html, publicly available at least as early as 1 year prior to Dec. 9, 2011 (3 pages).

(Continued)

*Primary Examiner* — Joseph M. Rocca
*Assistant Examiner* — Syed A Islam
(74) *Attorney, Agent, or Firm* — JoAnn M. Seaton; Griffiths & Seaton PLLC

(57) ABSTRACT

A system is provided for hanging an overhead sign from a ceiling. The system includes an elongated member, a connector member, and a fastening mechanism. The elongated member includes an elongated portion and a set of two nodes formed on opposing ends of the elongated portion. A first node is configured to be coupled to the overhead sign. The connector member includes a hook, an extended portion, and a disk. The extended portion defines a first end and a second end opposite the first end. The hook extends from the first end of the extended portion and is coupled to the second node. The disk extends radially outwardly from the second end of the extended portion for rotatable attachment to the ceiling. The fastening mechanism is inserted through the second node and the hook of the connector member.

24 Claims, 10 Drawing Sheets

(56) References Cited

U.S. PATENT DOCUMENTS

| | | | | |
|---|---|---|---|---|
| 5,794,894 | A | 8/1998 | Fremund | |
| 6,036,153 | A | 3/2000 | Rose et al. | |
| 7,065,912 | B2 | 6/2006 | Pitcher | |
| 7,805,904 | B2 | 10/2010 | Clark et al. | |
| 7,845,609 | B2 | 12/2010 | Bernard | |
| 7,895,784 | B1 | 3/2011 | Clark et al. | |
| 2005/0001136 | A1 * | 1/2005 | Fleishman | 248/489 |

OTHER PUBLICATIONS

"Versa-Tools "Ladderless" Sign Hanging," www.hangups.com/VersaTool.html, publicly available at least as early as 1 year prior to Dec. 9, 2011 (2 pages).

"Clik-Clik Your Sign Is Hung!," Brochure from Clik-Clik Systems, Inc., Buffalo, NY, publicly available at least as early as 1 year prior to Dec. 9, 2011 (2 pages).

* cited by examiner

SYSTEMS AND METHODS FOR HANGING OVERHEAD SIGNS FROM A CEILING

BACKGROUND OF THE INVENTION

Various types of displays are used to provide merchandise information and other information to consumers in a retail environment. Displays include overhead signage designed to readily provide information about a product, to draw the attention of the customer, and to promote retail sales. Overhead signage that is able to be efficiently set up, broken down, and adjustable is versatile, more easily shipped and stored, and adaptable for use with different ceiling fixtures. As such, these types of displays provide a more efficient use of resources, including increased sales, better use of employee time, and reduced costs. While traditional overhead signage systems accomplish these features to some extent, enhancements in the simplicity, or overall merchandising effectiveness, of such systems remain to be realized.

SUMMARY OF THE INVENTION

One aspect of the present invention relates to a system for hanging an overhead sign from a ceiling. The system includes an elongated member, a connector member, and a fastening mechanism. The elongated member includes an elongated portion and a set of two nodes formed on opposing ends of the elongated portion. The set of two nodes includes a first node and a second node. The first node is configured to be coupled to the overhead sign. The connector member includes a hook, an extended portion, and a disk. The extended portion defines a first end and a second end opposite the first end. The hook extends from the first end of the extended portion and is coupled to the second node of the elongated member, and the disk extends radially outwardly from the second end of the extended portion for rotatable attachment to the ceiling. The fastening mechanism is inserted through the second node of the elongated member and the hook of the connector member.

BRIEF DESCRIPTION OF THE DRAWINGS

Embodiments of the invention will be described with respect to the figures, in which like reference numerals denote like elements, and in which.

DETAILED DESCRIPTION

Figure 1:
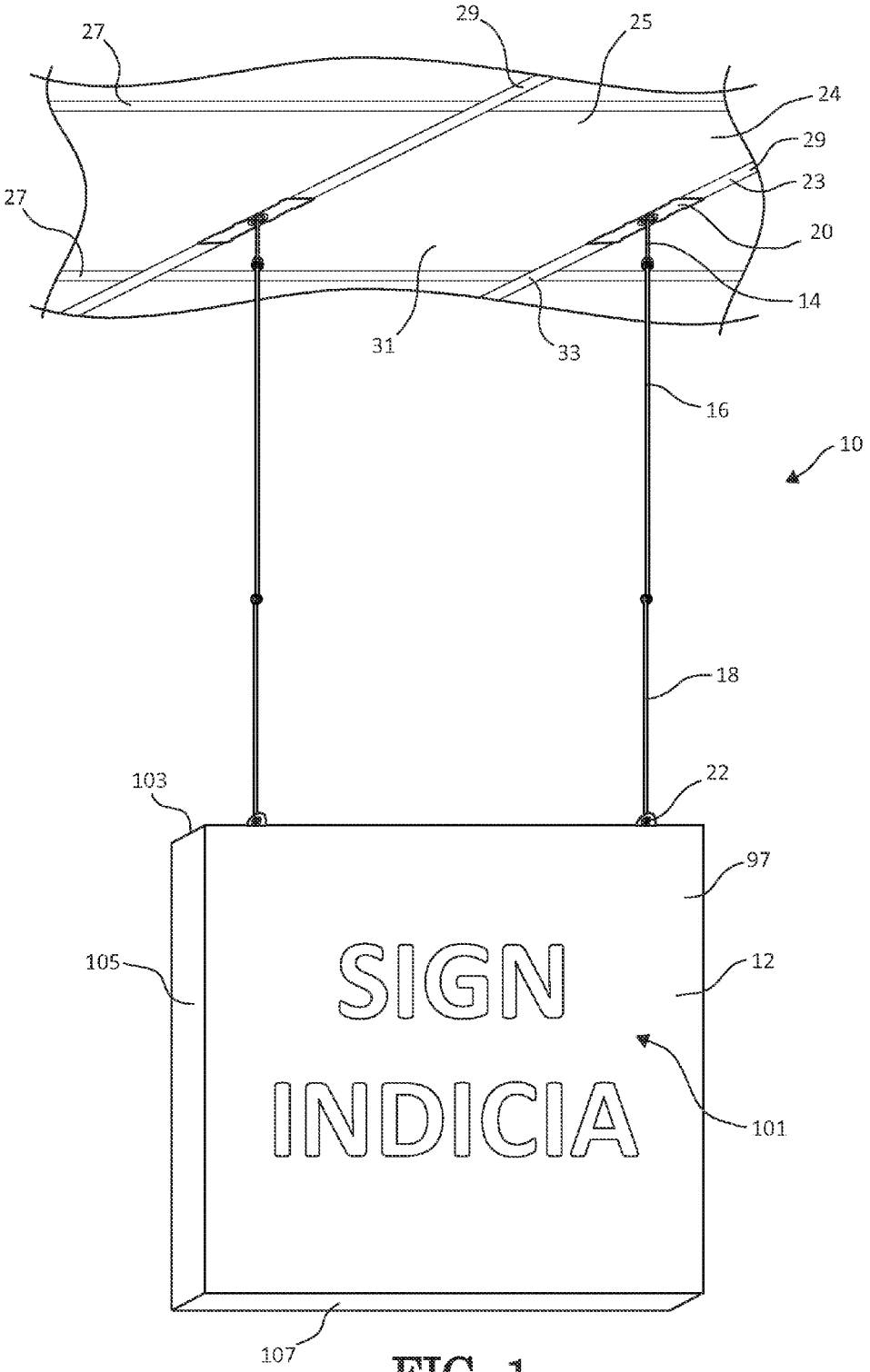
FIG. 1 is a front, perspective view illustration of an overhead signage display system, according to one embodiment of the present invention.
Figure 2:
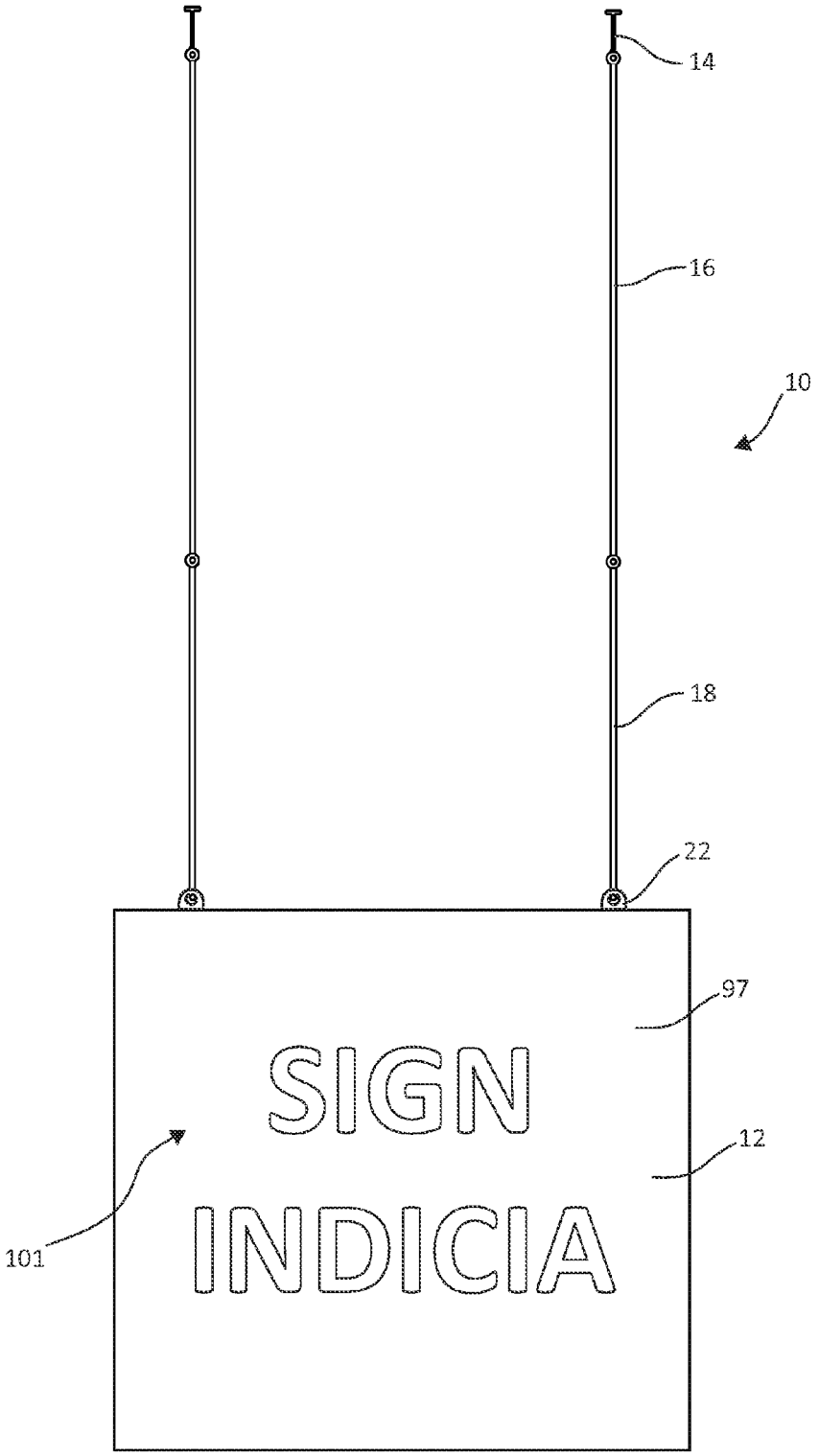
FIG. 2 is a front view illustration of the overhead signage display system of FIG. 1, according to one embodiment of the present invention.
Figure 3:
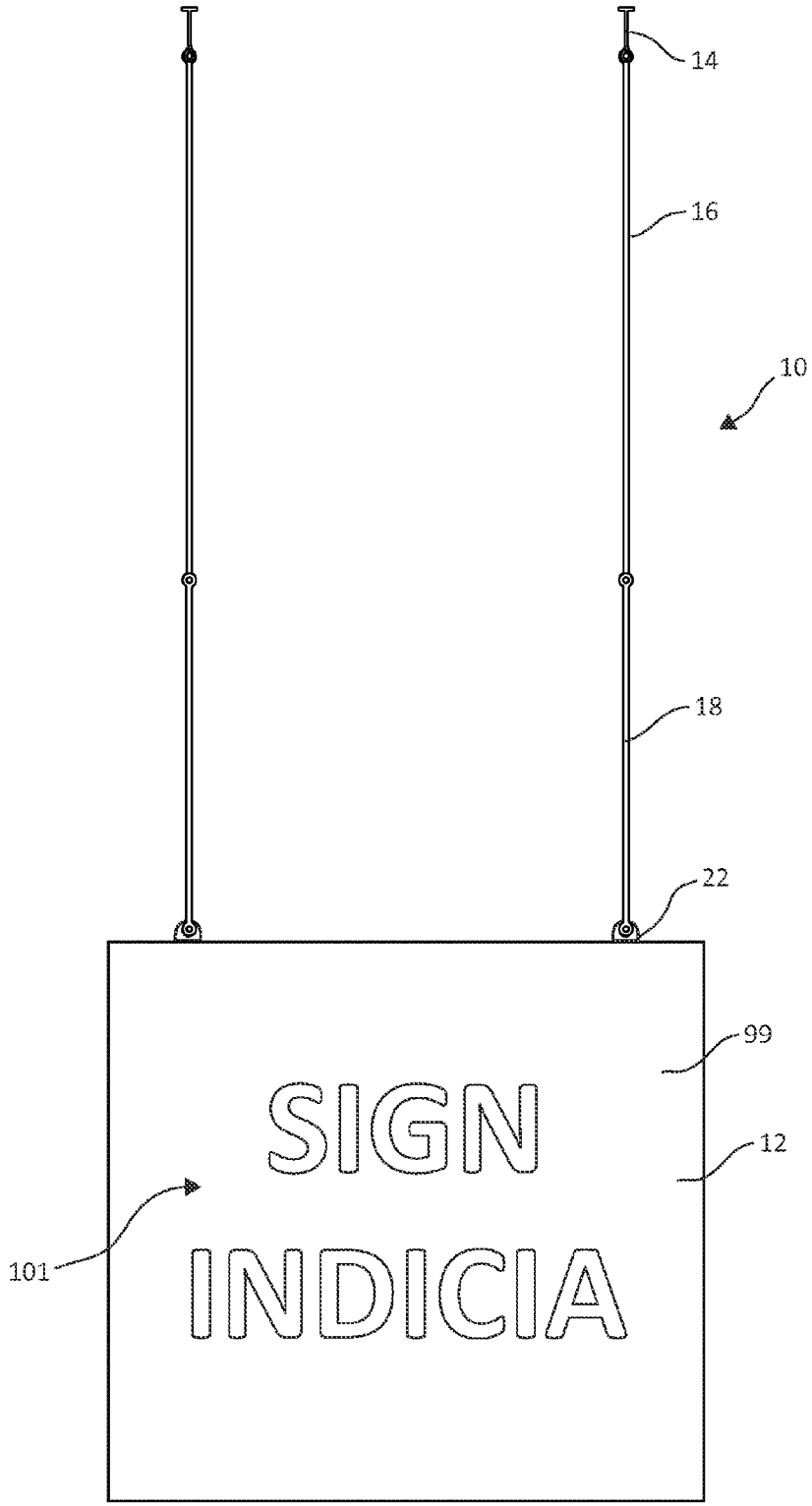
FIG. 3 is a rear view illustration of the overhead signage display system of FIG. 1, according to one embodiment of the present invention.
Figure 4:
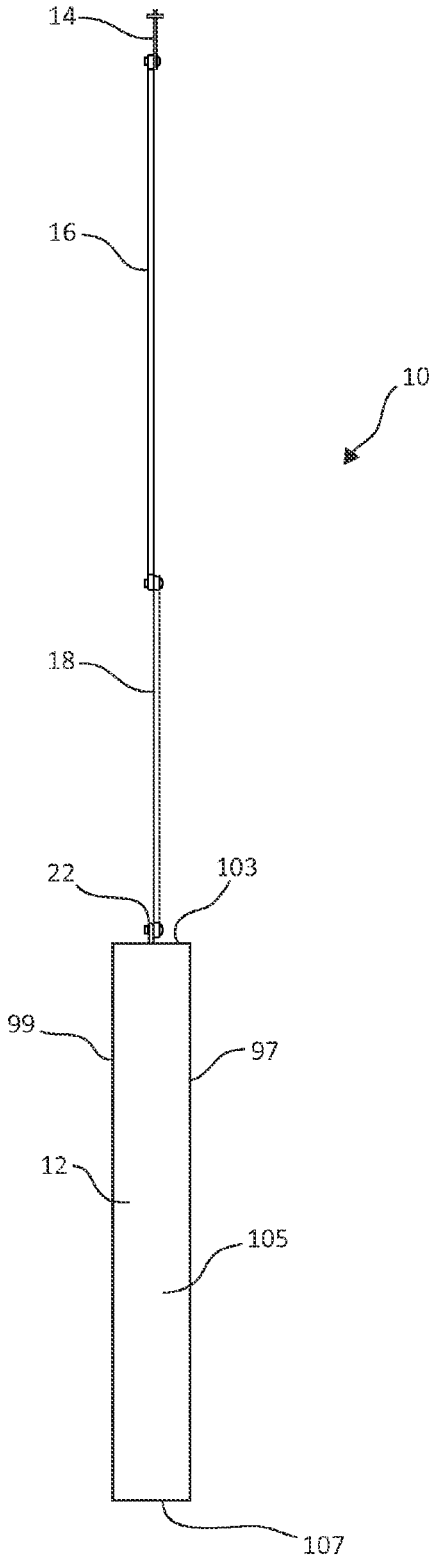
FIG. 4 is a side view illustration of the overhead signage display system of FIG. 1, according to one embodiment of the present invention.

The following detailed description of the invention provides examples and is not intended to limit the invention or the application and uses of the invention. Furthermore, there is no intention to be bound by any theory presented in the preceding background of the invention or the following detailed description of the invention.

Systems, kits, and methods are provided for hanging overhead signage from a ceiling. According to one embodiment, the overhead signage display system is versatile and adaptable for use with various types of ceiling fixtures. Additionally, the system is lightweight and relatively low cost to manufacture and assemble.

In particular, in an example, the system includes an elongated member, a connector member, and a fastening mechanism. The elongated member includes an elongated portion and a set of two nodes formed on corresponding ends of the elongated portion, each node of the set of two nodes has a first opening formed therethrough, and a first node of the set of two nodes has an extended portion, a hook, and a disk. The hook is formed on a first end of the extended portion and is coupled to a second node of the set of two nodes. The disk extends radially outwardly from a second end of the extended portion opposite the first end of the extended portion for securement to the ceiling. The fastening mechanism is inserted through the second node of the set of two nodes and the hook of the connector member.

The system optionally includes more than one elongated member. More particularly, when hanging a sign, a number of elongated members are selected to position the sign at a desired height or distance away from the ceiling, the floor, or a product over which the sign is disposed. For example, depending on a distance between the ceiling and the floor or the ceiling and the product, a single elongated member can be used to hang the sign or multiple elongated members can be connected together to ensure the sign hangs at a visually appealing height. In this manner, the system has a large degree of flexibility for use in a variety of environments and overall display plans.

Turning to the figures, FIGS. 1-4 illustrate various views of one embodiment of a system for hanging an overhead sign (e.g., sign 12) from a ceiling or overhead signage display system 10. System 10 includes connector members or ceiling hooks or securement members 14, top elongated members or attachment rods 16, bottom elongated members or attachment rods 18, bracket members or clips 20, and signage tabs 22. Connector members 14 attach to clips 20, which are selectively coupled to railings 23 of an overhead support 24 (e.g., a suspended ceiling). Top and bottom elongated members 16 and 18 are attached together end to end between connector members 14 and tabs 22. Tabs 22 attach to sign 12 for use in coupling sign 12 to system 10. These components are described in further detail below.

Figure 5:
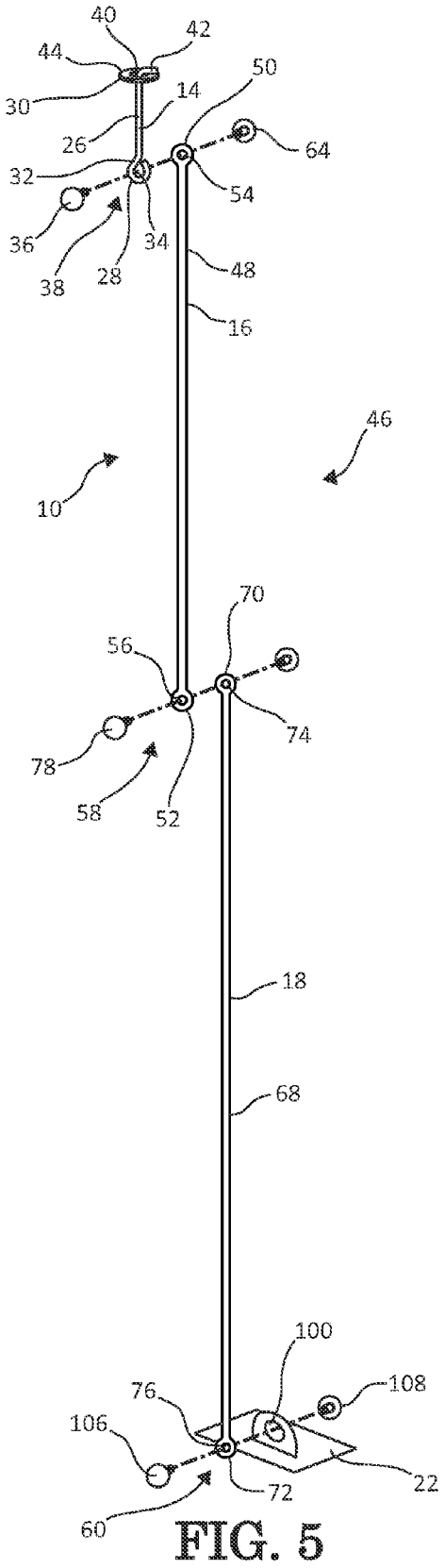
FIG. 5 is an exploded view illustration of a portion of the overhead signage display system of FIG. 1, according to one embodiment of the present invention.
Figure 6:
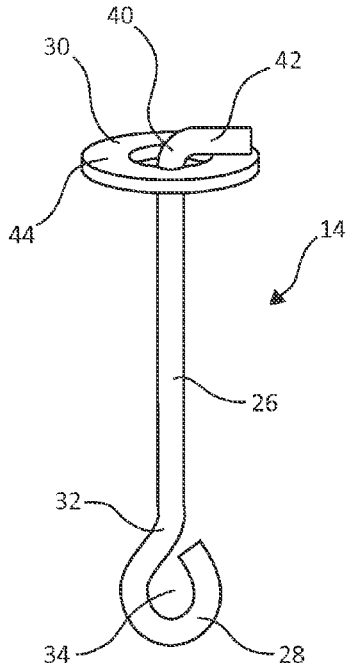
FIG. 6 is a front view illustration of a connector member of the overhead signage display system, according to one embodiment of the present invention.
Figure 7:
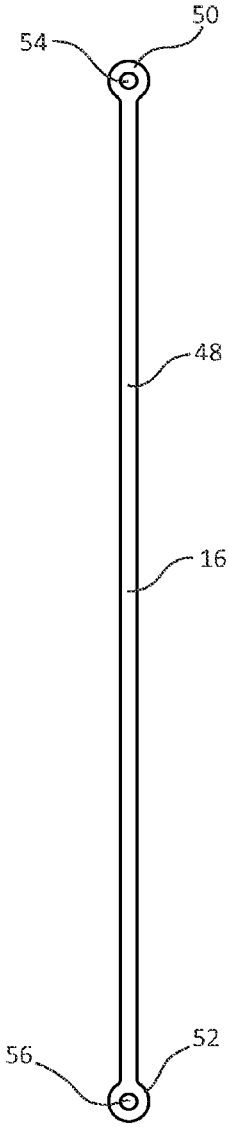
FIG. 7 is a front view illustration of an attachment member of the overhead signage display system, according to one embodiment of the present invention.
Figure 8:
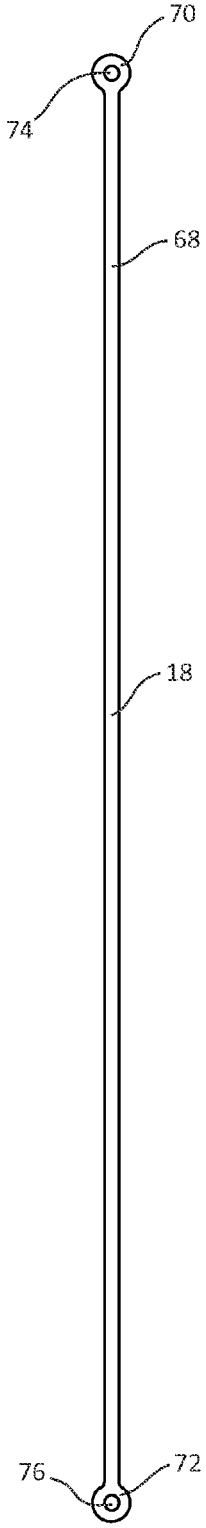
FIG. 8 is a front view illustration of an attachment member of the overhead signage display system, according to another embodiment of the present invention.

With additional reference to FIGS. 5 and 6, connector members 14 are configured to secure elongated members 16 and 18 to overhead support 24 and to rotate relative to overhead support 24 when coupled to railing 23. To provide sufficient structural integrity to support sign 12, connector members 14 are formed from metal, plastic, polyfluorotetraethylene, and/or other suitable materials. Each connector member 14 includes an extended or linear portion 26, a hook or hook portion 28, and a disk or disk portion 30. Extended portion 26 is substantially linear, in an embodiment. In another example, extended portion 26 forms a spiral, curve or another substantially linear or curvilinear shape.

Hook 28 is configured to couple to an elongated member (e.g., top elongated member 16 as illustrated herein, or bottom elongated member 18 in other embodiments) and is formed on a first end 32 of extended portion 26. According to an embodiment, hook 28 extends away from first end 32 of extended portion 26 at an angle and then curves back toward first end 32 to define an aperture 34. In an example, hook 28 is an open loop (e.g., an end of hook 28 forms a gap with first end 32 of extended portion 26). In another embodiment, hook 28 is substantially closed (e.g., the end of hook 28 contacts and/or is coupled to first end 32 of extended portion 26). No matter the particular configuration of hook 28, aperture 34 is configured to receive a fastening mechanism or fastener 38 for coupling to elongated member 16 or 18. Although hook 28 is illustrated as being teardrop-shaped in the Figures, hook 28 alternatively may be circular, ovular, or any other shape suitable for providing aperture 34.

Disk 30 extends radially outwardly from a second end 40 of extended portion 26 opposite first end 32 of extended portion 26. In an example, disk 30 is formed directly on second end 40 of extended portion 26. For example, disk 30 comprises a circular plate and second end 40 of extended portion 26 extends directly from a location at substantially the center of the circular plate. In another embodiment, disk 30 is coupled to second end 40 of extended portion 26. More particularly, disk 30 comprises a washer, and second end 40 of extended portion 26 is bent at an angle to form a flange 42. Extended portion 26 extends through an opening in disk 30 so that flange 42 is coupled to an upper surface 44 of disk 30. Although flange 42 is depicted as extending substantially perpendicularly to a remainder of extended portion 26, flange 42 extends at a non-perpendicular angle relative to the remainder of extended portion 26 in other embodiments.

Elongated members 16 and 18 form an elongated member assembly 46 for spacing sign 12 a desired distance from overhead support 24. According to an embodiment, elongated member assembly 46 has a total length that is greater than a length of connector member 14. Each elongated member 16 and 18 of elongated member assembly 46 is formed from plastic or another lightweight material that is also capable of providing sufficient structural integrity to support sign 12 when system 10 is hung from overhead support 24.

In an example, elongated member 16 has a length or an elongated portion 48, a set of two nodes 50 and 52, and openings 54 and 56. Elongated portion 48 is a rod and has a rectangular radial cross-section, in an embodiment. For example, elongated portion 48 has opposing, substantially parallel first and second major planar surfaces and first and second side surfaces therebetween to define the rectangular radial cross section. Alternatively, elongated portion 48 has a circular, ovular, triangular, or other polygonal radial cross section. In one embodiment, each elongated member 16 is cut from plastic or metal sheet stock of a suitable thickness or is formed of injection molded plastic such that elongated member 16 has a suitable thickness and configuration.

Nodes 50 and 52 are formed on corresponding ends of elongated portion 48. In an example, nodes 50 and 52 are circular and one or both of nodes 50 and 52 has a diameter that is greater than a width of elongated portion 48 (e.g., a measurement taken from first side surface to second side surface). In another embodiment, one or both of nodes 50 and 52 is semi-circular and has a diameter that is substantially equal to the width of elongated portion 48. Nodes 50 and 52 are substantially equal in diameter to each other, in an embodiment. Alternatively, one node 50 or 52 is larger than the other node 50 or 52. According to an embodiment, nodes 50 and/or 52 are non-circular and, instead, have a polygonal shape, such as triangular, square, rectangular, and the like.

Bottom elongated member 18 is configured substantially similarly to top elongated member 16, except that, in one example, bottom elongated member 18 is longer than top elongated member 16. In particular, bottom elongated member 18 has an elongated portion or length 68, a set of nodes 70 and 72, and openings 74 and 76. Nodes 70 and 72 are substantially similar to nodes 50 and 52 of top elongated member 16, and elongated portion 68 is longer than elongated portion 48 of top elongated member 16. In other embodiments, bottom elongated member 18 is substantially equal in length or shorter than top elongated member 16.

To couple elongated members 16 and 18 together and/or to couple elongated member 16 or 18 to connector member 14, each of elongated members 16 and 18 includes two of openings 54, 56, 74, and 76. Specifically, openings 54 and 56 are formed on opposing ends of elongated portion 48, and openings 74 and 76 are formed on opposing ends of elongated portion 68. In an embodiment, openings 54 and 56 are formed through nodes 50 and 52, respectively, and openings 74 and 76 are formed through nodes 70 and 72, respectively. To allow interchangeability of one elongated member 16 for another elongated member 18 during assembly and to simplify assembly, openings 54, 56, 74, and 76 preferably define diameters that are substantially equal to each other. In another embodiment, the diameters of openings 54, 56, 74, and 76 are suitable for receiving a portion of a corresponding fastening mechanism or fastener 38, 58, or 60. In another example, one or more of openings 54, 56, 74, and/or 76 is larger than another.

Although elongated member assembly 46 is illustrated as including two elongated members 16 and 18, other embodiments include a single elongated member (either elongated member 16 or elongated member 18) or more than two members. In particular, vertical positioning of sign 12 can be adjusted relative to the ceiling, floor, or product supported on the floor below sign 12 by selecting a suitable total number of elongated members 16 and/or 18 to be used in system 10. No matter the total number of elongated members, a free end of elongated member assembly 46 (here, end of bottom elongated member 18) is coupled to sign 12. In an example in which elongated member assembly 46 omits bottom elongated member 18, a free end of top elongated member 16 is coupled to sign 12.

Figure 9:
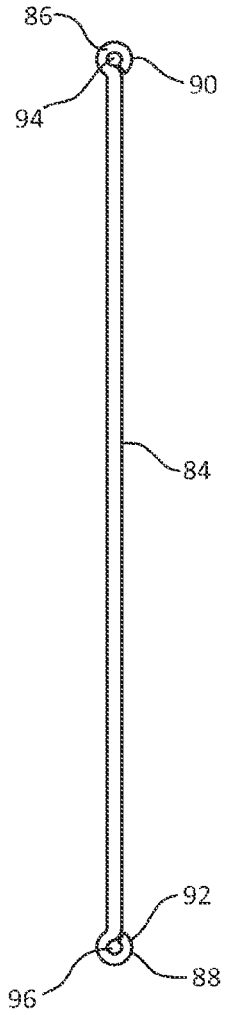
FIG. 9 is a front view illustration of an attachment member of the overhead signage display system, according to still another embodiment of the present invention
Figure 10:
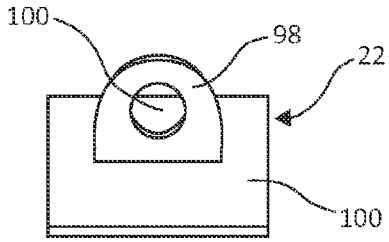
FIG. 10 is a top perspective view illustration of a tab, according to one embodiment of the present invention.
Figure 11:
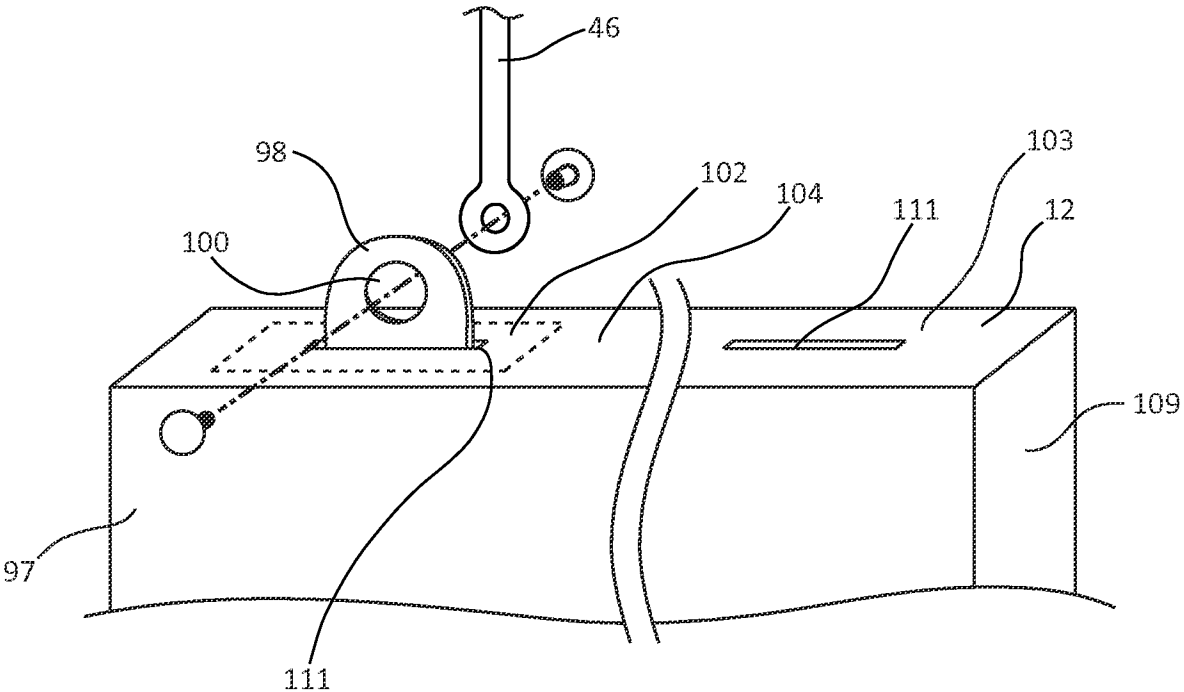
FIG. 11 is a close up, exploded view illustration of the tab attached to a sign and an end of an attachment member and fastening mechanism, according to one embodiment of the present invention.

FIG. 9 is a front view of an elongated member 84, according to an embodiment. Here, elongated member 84 is formed substantially similarly to elongated members 16 or 18, except that elongated member 84 comprises a metallic material and nodes 86 and 88 are defined by hooked ends or hooks 90 and 92. Hooks 90 and 92 comprise loops that are open and include openings 94 and 96 that are substantially similar in shape and size and suitably configured for aligning with one or more of aperture 34, an opening of another metallic elongated member, or other opening to receive a fastening mechanism (e.g., fastening mechanism 58 or 60). Although a single elongated member 84 is shown, it will be appreciated that more than one elongated member configured substantially similarly to elongated member 84 is used in other embodiments and are coupled end to end to each other.

In still another example, one or more elongated members 84 are used in conjunction with one or both of elongated members 16 and/or 18 to attach sign 12 to connector member 14. In such an embodiment, openings 94 and/or 96 are substantially similar in shape and size configured to be aligned with openings 54 or 56 or openings 74 or 76.

Referring now to FIGS. 1-4, 10, and 11, tab 22 is configured to couple sign 12 to elongated member assembly 46. Sign 12 is a box or box frame structure and is formed of a cardboard, plastic, or another suitable material. Sign 12 includes major, planar panels 97 and 99 and side panels 103, 105, 107, and 109. In an embodiment, top side panel 103 is employed to hang sign 12 and includes slits 111. Top panel 103 is illustrated as including two slits 111. However, in other embodiments more than two slits are included. One or more of panels 97, 99, 103, 105, 107, and 109 include indicia 101 for displaying retail and/or product information. For example, indicia 101 identify store, department, product, brand or other information for drawing customer attention and/or to promote product.

Tab 22 includes an assembly attachment portion 98 and a remainder portion 102. Assembly attachment portion 98 is substantially planar and is bent at an angle relative to remainder portion 102. In an example, assembly attachment portion 98 is disposed substantially perpendicularly relative to remainder portion 102. According to another embodiment, assembly attachment portion 98 is non-perpendicular relative to remainder portion 102. Although assembly attachment portion 98 is illustrated as being substantially semi-circular, assembly attachment portion 98 has a different shape, such as square, rectangular, semi-ovular, and the like, in other examples.

Assembly attachment portion 98 includes a hole 100 for attaching tab 22 to elongated member assembly 46. Hole 100 is formed in substantially the center of assembly attachment portion 98, in an embodiment. Alternatively, hole 100 is located adjacent to a periphery of assembly attachment portion 98 or adjacent to an intersection between assembly attachment portion 98 and remainder portion 102. Hole 100 has a diameter that is suitably dimensioned for receiving fastening mechanism 60. Although hole 100 is illustrated as being substantially circular, hole 100 is square, rectangular, or another shape in other embodiments.

Remainder portion 102 is substantially planar to allow assembly attachment portion 98 to extend therefrom. In an example, remainder portion 102 is substantially rectangular, and has assembly attachment portion 98 extends from a middle portion of remainder portion 102. Thus, when remainder portion 102 is disposed in sign 12, surfaces of remainder portion 102 may be adhered or otherwise coupled to a non-exposed surface of top wall 103 of sign 12 or may have sufficient structural integrity to be retained within sign 12 without additional mechanical coupling. In another embodiment, remainder portion 102 is circular, ovular, square, or another polygon suitable for allowing assembly attachment portion 98 to extend therefrom. Remainder portion 102 has an area measurement that is larger than an area measurement of assembly attachment portion 98. Alternatively, the areas of each portion 98 and 102 are substantially equal or portion 98 is larger than portion 102.

In an embodiment, assembly attachment portion 98 is configured to extend substantially perpendicularly relative to remainder portion 102. In another example, portions 98 and 102 are non-perpendicular relative to each other.

Tab 22 comprises a single material, in an embodiment. For example, tab 22 is formed of a plastic material, metallic material, cardboard, nylon, or another material suitable for supporting sign 12. Alternatively, assembly attachment portion 98 is formed from a different material than remainder portion 102 and the two portions 98 and 102 are adhered or otherwise coupled together.

Turning now to FIGS. 1-4 and 12, clips 20 attach connector members 14 (hence, system 10) to railings 23 of overhead support 24. Each clip 20 includes a plate or planar portion 112 and has a main opening or slot 114 and ceiling attachment clasps 116, and 118. Although plate 112 is shown as being substantially rectangular, plate 112 is square, ovular or another shape in other embodiments.

Main opening 114 is configured to allow extended portion 26 and hook 28 to pass through and to retain disk 30 against surface 120 of plate 112. In an example, main opening 114 is formed in a central portion of plate 112. Alternatively, main opening 114 is formed adjacent to an edge of plate 112. Although main opening 114 is illustrated as being square-shaped, it is circular, ovular or another shape in other examples. In an embodiment, a shallow channel 122 is formed in surface 120 surrounding main opening 114 for disk 30 to fit snugly and to rotate therein.

Ceiling attachment clasps 116 and 118 are employed to attach clip 20 to railing 23 generally without the use of additional fasteners. Clasps 116 and 118 comprise spring components that can be temporarily deformed to attach to railing 23, in an embodiment. For example, clasps 116 and 118 comprise metal material, plastic or another spring-like material. In an embodiment, ceiling attachment clasps 116 and 118 are attached to opposing longitudinal edges 124 and 126 of plate 112 and extend inwardly over plate 112. Ceiling attachment clasps 116 and 118 are disposed on opposite corners of opposing edges 124 and 126, in an example. Clasps 116 and 118 are arranged around plate 112 such that clasp 116 attaches one edge of plate 112 to one side of railing 23, and clasp 118 attaches another edge of plate 112 to another side of railing 23. Alternatively, ceiling attachment clasps 116 and 118 extend from other surfaces on plate 112 without obstructing main opening 112.

With reference now to FIGS. 1-5, 10, 11, and 13, to assemble system 10 for displaying sign 12 via method 1000, tabs 22 are attached to sign 12, step 1002. In particular, tabs 22 (e.g., two tabs 22) are inserted through respective slits 103 on sign 12 such that remainder portions 102 of tabs 22 remain within an interior of sign 12 and assembly attachment portions 98 including holes 100 are exposed. For example, remainder portion 102 is adhered to a bottom surface of top side panel 103 and/or is sufficiently rigid to allow sign 12 to hang with gravitational forces.

Before, after, or concurrently with attachment of tabs 22 to sign 12, connector members 14, clips 20, and elongated members 16 and 18 are assembled together, step 1004. In an embodiment, two sets of connector members 14, clips 20, and elongated members 16 and 18 are assembled together. As illustrated, for example, with additional reference to FIG. 12, each connector member 14 is inserted through a corresponding main opening 114 of one clip 20 so that disk 30 is disposed on one side of clip 20 and hook 28 is disposed on the other side of clip 20. Turning to FIG. 5, for each connector member 14, opening 54 of top elongated member 16 is aligned with aperture 34 of hook 28 of connector member 14, and fastening mechanism 38 is inserted through both opening 54 and aperture 34. In an example, fastening mechanism 38 includes a rivet nut 36 and a screw 64. In such case, rivet nut 36 has a head and a stem where the head is larger than opening 54 and aperture 34. In an embodiment, the head of rivet nut 36 is similarly sized to node 50 of top elongated member 16 and/or hook 28. The stem of rivet nut 36, which includes a threaded cavity, is inserted through both opening 54 and aperture 34 and has a length that is at least as long as a total thickness of node 50 and hook 28. Screw 64 is received by threaded cavity of rivet nut 36. In other embodiments, fastening mechanism 38 comprises a threaded screw and a mating nut, a bolt with a nut, or another component suitable for coupling connector member 14 to top elongated member 16.

Before or after connector members 14 and top elongated members 16 are coupled together, opening 56 of each top elongated member 16 is aligned with opening 74 of each bottom elongated member 18. Fastening mechanisms 58, each of which includes a rivet nut 78 and a screw 80, are inserted through openings 56 and 74 of each top and bottom elongated members 16 and 18, respectively. Each rivet nut 78 includes a stem including a threaded cavity that receives an outer threaded surface of a corresponding screw 80 to couple rivet nut 78 to screw 80 to thereby couple top and bottom elongated members 16 and 18 to each other. Each rivet nut 78 has a head and a stem where the head is larger than openings 56 and 74. In an embodiment, the head of rivet nut 78 is similarly sized to node 52 of top elongated member 16 and/or node 72 of bottom elongated member 18. The stem of rivet nut 78 is inserted through both openings 56 and 74 and has a length that is at least as long as a total thickness of node 52 and node 70. In other embodiments, fastening mechanisms 58 comprise a threaded screw and a mating nut, a bolt with a nut, or another component suitable for coupling elongated members 16 and 18 to each other.

Opening 76 of each bottom elongated member 18 is aligned with a corresponding hole 100 of each tab 22 to allow fastening mechanisms 60 to be inserted through holes 100 and openings 76. Fastening mechanisms 60 include a rivet nut 106 and a screw 108, in accordance with an embodiment. Rivet nut 106 has a head and a stem where the head is larger than opening 76 and hole 100. In an example, the head of rivet nut 106 is similarly sized to node 72 of bottom elongated member 18. The stem of rivet nut 106, which includes a threaded cavity, is inserted through both opening 76 and hole 100 and has a length that is at least as long as a total thickness of node 72 and tab 22. In another embodiment, fastening mechanisms 60 comprise a bolt and a nut, a screw and a nut, or another component suitable for fastening tabs 22 to elongated members 18. In one embodiment, fastening mechanism 38, 58, and 60 are substantially identical. It will be understood by those with skill in the art that one or more additional elongated members alternatively can be included between elongated members 16 and 18 to lengthen elongated member assembly 46.

In embodiments in which bottom elongated member 18 is omitted, opening 56 of top elongated member 16 is aligned with hole 100 of tab 22 to couple top elongated member 16 and tab 22 together. In other embodiments in which additional elongated members are employed, opening 76 of bottom elongated member 18 is aligned with an opening of the additional elongated member and an opening on a free end of the additional elongated member is used for coupling to tab 22.

Figure 12:
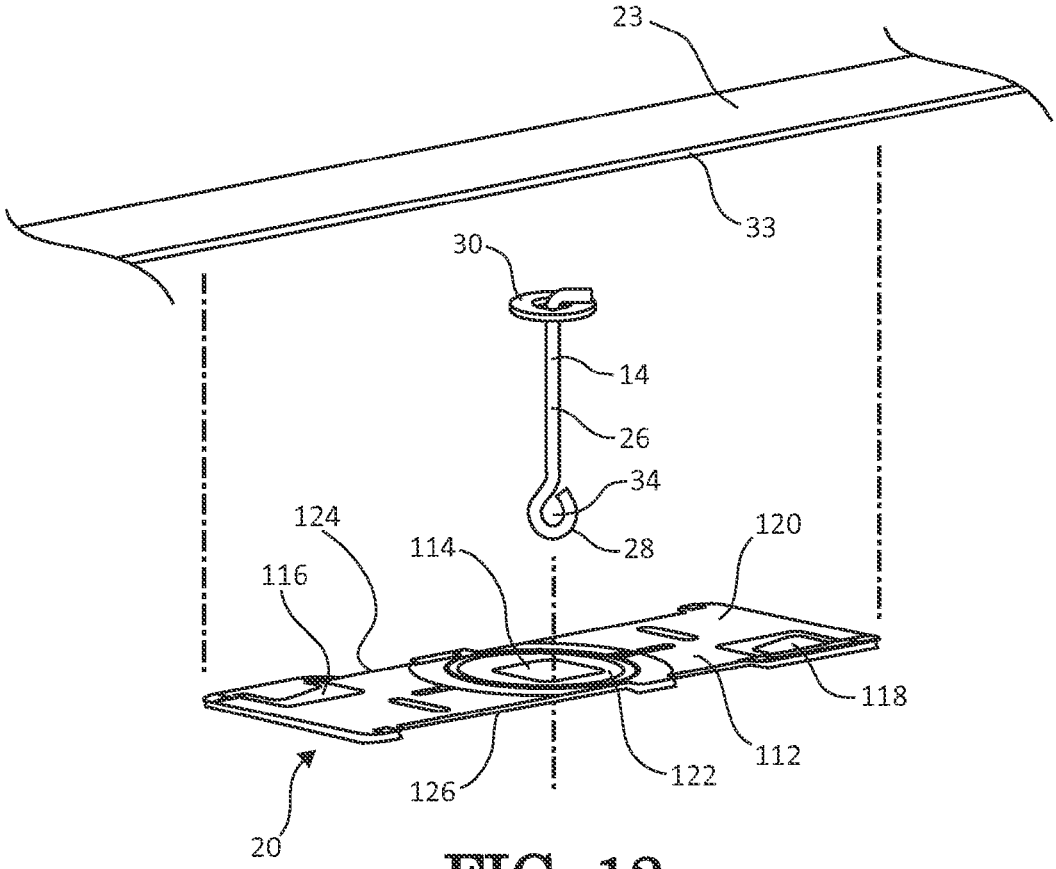
FIG. 12 is an exploded view illustration of a clip and a connector member of the overhead signage display system for attachment to a rail, according to one embodiment of the present invention.
Figure 13:
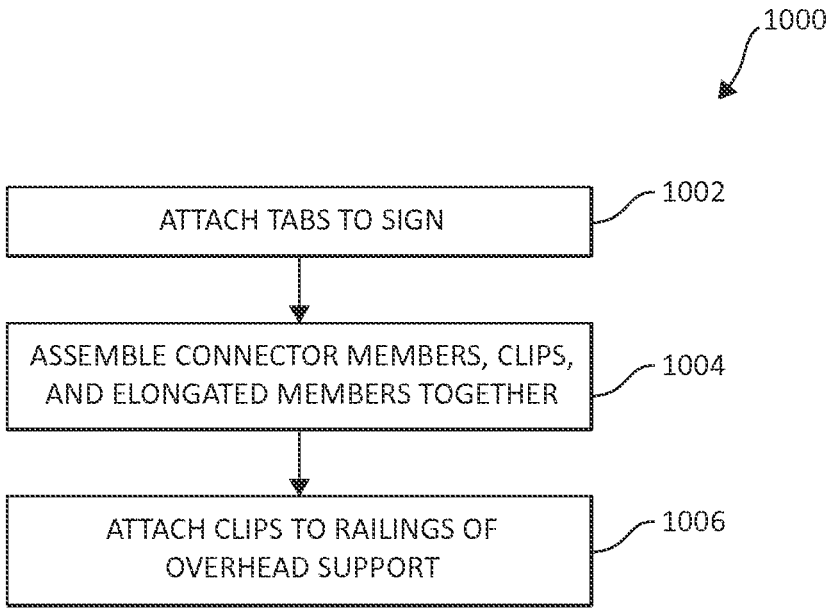
FIG. 13 is a flow diagram of a method of assembling an overhead signage display system, according to one embodiment of the present invention.

Referring now to FIGS. 1, 12, and 13 after system 10 is assembled, clips 20 are attached to railings 23 of overhead support 24, step 1006. In an example, overhead support 24 includes railings 23 that are arranged into a grid 25. Specifically, grid 25 includes first set of substantially parallel railings 27 that extend across a second set of substantially parallel railing 29 at a substantially perpendicular angle forming substantially square openings within which ceiling tiles 31 are disposed. Railings 27 and 29 are substantially planar components, each having a length extending across overhead support 24 and an exposed surface 33 that faces toward a floor opposite overhead support 24.

Plate 112 of each clip 20 is positioned against a desired location on exposed surface 33 of a corresponding railing 23. Plate 112 is then manipulated, e.g., rotated via an extension pole (not shown), to allow corresponding railing 23 to slide in between plate 112 and clasps 116 and 118. In other embodiments, clasps 116 and 118 are configured to be manipulated between various positions resulting in attachment of clip 20 to the corresponding railing 23. After use, clip 20 is easily removed from railing 23 by reverse movement of plate 112.

By including one or more elongated members (e.g., elongated members 16 and/or 18) that are coupled together using fastening mechanisms such as rivets and screws, bolts and nuts, and the like, overhead signage display systems and methods are provided that are versatile and easily adaptable for use in retail stores having various ceiling configurations (such as ceiling height, fixture placement, display configurations, and the like). Use of a connector member, such as that described above can be used in conjunction with any one of numerous conventional components for attachment to various types of ceiling fixtures. Additionally, forming components of the system from plastic and/or metal, the system is lightweight and relatively low cost to manufacture and assemble.

Components of the overhead signage display system can be included in a kit for ease of distribution to various retail stores. The overhead signage display systems can be moved from location to location within a retail setting to direct a consumer to a location of a particular product. For example, the display system can be placed over the particular product so that the consumer can immediately identify the product location from a distance. Additionally, by providing colorful and/or eye-catching signage, the overhead signage display system is an aesthetically appealing method for promoting particular departments, brands, goods, products, and the like.

Although the invention has been described with respect to particular embodiments, such embodiments are meant for illustrative purposes only and should not be considered to limit the invention. Various alternatives and changes will be apparent to those of ordinary skill in the art. Other modifications within the scope of the invention and its various embodiments will be apparent to those of ordinary skill.

What is claimed is:

1. A system for hanging an overhead sign from a ceiling, the system comprising:

a first elongated member including a first elongated portion and a first set of two nodes formed on opposing ends of the first elongated portion, wherein the first elongated member is formed as a single piece of material, the first set of two nodes includes a first node and a second node, and the first node is configured to be coupled to the overhead sign;

a connector member including a hook, an extended portion, and a disk, wherein the extended portion defines a first end and a second end opposite the first end, the hook extends from the first end of the extended portion and is coupled to the second node of the first elongated member, and the disk extends radially outwardly from the second end of the extended portion for rotatable attachment to the ceiling; and a fastening mechanism formed separately from each of the first elongated member and the connector member and inserted through the second node of the first elongated member and the hook of the connector member to secure the first elongated member to the connector member of the first elongated member and to maintain the hook of the connector member in direct contact with the first elongated member.

2. The system of claim 1, further comprising:

a bracket member including a planar portion and a slot formed through the planar portion, wherein:

the connector member is inserted through the slot such that the disk is disposed on a first side of the planar portion, the hook is disposed on a second side of the planar portion, and the bracket member is configured to be coupled to the ceiling, and the connector member is formed as a single piece member.

3. The system of claim 1, wherein:

the second node of the first elongated member has an opening, the hook of the connector member has an aperture, the fastening mechanism comprises a rivet nut and a screw, the rivet nut has a stem and a cavity, the stem of the rivet nut extends through the aperture of the hook, and the cavity of the rivet nut receives the screw.

4. The system of claim 1, further comprising:

a second elongated member including a second elongated portion and a second set of two nodes formed on opposing ends of the second elongated portion, wherein the second set of nodes of the second elongated member includes a third node configured to be coupled to the overhead sign and a fourth node coupled to the first node of the first elongated member such that the first node of the first elongated member is coupled to the overhead sign via the second elongated member.

5. The system of claim 4, further comprising a fastening mechanism comprising a rivet nut and a screw, wherein:

the first node of the first elongated member has a first opening, the fourth node of the second elongated member has a second opening aligned with the first opening, the rivet nut has a head and a stem, the head is larger than the first node and the fourth node, and the stem has a cavity extending at least partially therethrough, the stem of the rivet nut extends through the first opening and the second opening, and the cavity of the rivet nut receives the screw.

6. The system of claim 1, wherein the first node and the second node of the first set of two nodes have substantially equal outer diameters.

7. The system of claim 1, wherein:

the first elongated portion of the first elongated member has a width, the first node of the first set of two nodes has an outermost diameter that is greater than the width of the first elongated portion of the first elongated member, and the first elongated portion the first node and the second node all have substantially the same thickness.

8. The system of claim 1, wherein the connector member comprises a metallic material.

9. The system of claim 1, wherein the first node and the second node each comprise an open loop.

10. The system of claim 9, wherein the first elongated member comprises a metallic material.

11. The system of claim 1, wherein the material is a planar sheet of plastic, and the first elongated member is cut from the planar sheet of plastic.

12. The system of claim 1, wherein the hook portion of the connector member extends in a first plane, the first node and the second node of the first elongated member substantially extend within a second plane, and the first plane extends substantially parallel to the second plane.

13. The system of claim 1, further comprising the overhead sign and a second fastening mechanism, wherein:

the overhead sign includes a substantially planar signage flange extending upwardly from a top edge of a remainder of the overhead sign and defining an aperture therethrough, the first elongated member is one of at least one elongated member of the system for hanging the overhead sign, each of the at least one elongated member includes a set of two nodes including a first node and a second node, the first node of a bottommost one of the at least one elongated member is coupled to and positioned immediately adjacent the substantially planar signage flange via the second fastening mechanism, and the second fastening mechanism is substantially identical to the fastening mechanism securing the first elongated member to the connector member.

14. A system for hanging an overhead sign from a ceiling, the system comprising:

a first elongated member including a first elongated portion and a first set of two nodes formed on opposing ends of the first elongated portion, wherein the first set of two nodes includes a first node and a second node, and the first node is configured to be coupled to the overhead sign;

a connector member including a hook, an extended portion, and a disk, wherein the extended portion defines a first end and a second end opposite the first end, the hook extends from the first end of the extended portion and is coupled to the second node of the first elongated member, and the disk extends radially outwardly from the second end of the extended portion for rotatable attachment to the ceiling; and a fastening mechanism inserted through the second node of the first elongated member and the hook of the connector member;

wherein:

the connector member includes a flange formed at an angle relative to the extended portion, the disk has a hole formed therethrough, the extended portion of the connector member extends through the hole, and the flange is coupled to a surface of the disk.

15. A display system kit for hanging an overhead sign from a ceiling, the display system kit comprising:

a first attachment rod having a first length, a first opening, and a second opening, the first opening and the second opening being formed on opposite ends of the first length, the first opening of the first attachment rod configured to facilitate coupling the first attachment rod to the overhead sign;

a first ceiling hook comprising a linear section, a hook portion, and a disk portion, the hook portion and the disk portion extending from opposing ends of the linear section, the hook portion having an aperture being aligned with the second opening of the first attachment rod, the disk portion being configured to attach to a coupling mechanism for coupling to the ceiling;

a plurality of substantially identical fasteners including a first fastener inserted through the second opening of the first attachment rod and the aperture of the hook portion to couple the first attachment rod to the first ceiling hook; and one or more additional attachment rods each having a second length and two openings each being formed on opposite ends of the corresponding second length;

wherein:

one of the two openings of each of the one or more additional attachment rods is coupled to one of the first opening of the first attachment rod and a different one of the two openings of a different one of the one or more additional attachment rods via a different one of the plurality of substantially identical fasteners.

16. The display system kit of claim 15, wherein the second length is different from the first length.

17. The display system kit of claim 15, wherein the fastener comprises a rivet nut and a screw.

18. The display system kit of claim 15, wherein the first attachment rod includes two circular ends, and the first opening and the second opening are each formed through one of the two circular ends.

19. The display system kit of claim 18, wherein the first attachment rod is formed as a single piece of plastic material.

20. The display system kit of claim 15, wherein the first attachment rod includes two hooked ends, and the first and second openings are each formed through one of the two hooked ends.

21. The display system kit of claim 15, wherein a different one of the two openings of a bottommost one of the one or more additional attachment rods is coupled to the overhead sign using another one of the plurality of substantially identical fasteners.

22. A method of displaying an overhead sign comprising:

coupling a first attachment member to the overhead sign, the first attachment member including a first end having a first opening formed therethrough;

inserting a first portion of a first fastening mechanism through the first opening of the first attachment member and through a first aperture of a hook end of a securement member;

securing a second portion of the first fastening mechanism to the first portion of the first fastening mechanism to couple the first attachment member to the securement member between the first portion and the second portion of the first fastening mechanism;

attaching a disk portion of the securement member to a clip coupled to an overhead support to display the overhead sign from the overhead support, wherein the disk portion of the securement member is positioned opposite the hook end of the securement member;

inserting a first portion of a second fastening mechanism through a second opening a second end of the first attachment member and through a first opening of a first end of a second attachment member;

securing a second portion of the second fastening mechanism to the first portion of the second fastening mechanism to couple the first attachment member to the second attachment member between the first portion and the second portion of the second fastening mechanism; and coupling the overhead sign to a second end of the second attachment member, wherein the second end of the second attachment member is positioned opposite the first end of the second attachment member.

23. The method of claim 22, wherein:

the first attachment member includes a first node and a second node on opposite ends of the first attachment member, and the first opening is formed through the first node.

24. The method of claim 22, wherein securing the second portion of the first fastening mechanism to the first portion of the first fastening mechanism secures the first attachment member in direct contact with the securement member.

* * * * *